US005506369A

United States Patent [19]

Kawamura et al.

[11] Patent Number: 5,506,369

[45] Date of Patent: Apr. 9, 1996

[54] ELECTROMAGNETIC ACTUATOR USED FOR KEYBOARD MUSICAL INSTRUMENT

[75] Inventors: Kiyoshi Kawamura; Shinya Koseki, both of Shizuoka, Japan

[73] Assignee: Yamaha Corporation, Japan

[21] Appl. No.: 317,345

[22] Filed: Oct. 4, 1994

[30] Foreign Application Priority Data

Oct. 8, 1993 [JP] Japan ..... 5-059799 U

[51] Int. Cl.[6] ..... G10F 1/02

[52] U.S. Cl. ..... 84/20; 84/107

[58] Field of Search ..... 84/20, 105, 107, 84/108, 109, 462

[56] References Cited

U.S. PATENT DOCUMENTS

| | | | |
|---|---|---|---|
| 893,710 | 7/1908 | Crippen | 84/20 |
| 1,504,531 | 8/1924 | Thomson et al. | 84/20 |
| 4,206,677 | 6/1980 | Ramsey | 84/107 |
| 4,216,694 | 8/1980 | Ramsey et al. | 84/107 |
| 4,338,847 | 7/1982 | Brennan | 84/20 |
| 4,513,652 | 4/1985 | Muramatsu et al. | 84/20 |
| 4,843,936 | 7/1989 | Murakami et al. | 84/107 |

FOREIGN PATENT DOCUMENTS

| | | |
|---|---|---|
| 50-399534 | 4/1975 | Japan . |
| 56-5190 | 1/1981 | Japan . |
| 2910 | of 1910 | United Kingdom . |

*Primary Examiner*—Thomas M. Dougherty
*Assistant Examiner*—Patrick J. Stanzione
*Attorney, Agent, or Firm*—Graham & James

[57] ABSTRACT

An electromagnetic actuator unit is provided over a keyboard of a piano, and each of the electromagnetic actuators of the electromagnetic actuator unit has a solenoid coil wound on a bobbin and a plunger for pushing down one of the keys, wherein the gravity exerted on the plunger is smaller than a recovery force of the key or a return spring coupled to the plunger is provided outside of the bobbin for smoothly moving the plunger without influences of the magnetic field produced by the solenoid coil.

6 Claims, 4 Drawing Sheets

ELECTROMAGNETIC ACTUATOR USED FOR KEYBOARD MUSICAL INSTRUMENT

FIELD OF THE INVENTION

This invention relates to an electromagnetic actuator and, more particularly, to an electromagnetic actuator used for a keyboard musical instrument.

DESCRIPTION OF THE RELATED ART

An array of electromagnetic actuators or an electromagnetic actuator unit is provided over a keyboard of an acoustic piano, and a controller selectively energizes the electromagnetic actuators for performing music.

A typical example of the electromagnetic actuator unit is illustrated in FIG. 1 of the drawings, and is attached to an acoustic piano in such a manner as to extend over a keyboard of the acoustic piano.

The prior art electromagnetic actuator unit comprises a casing 1 extending in the longitudinal direction of the keyboard of the acoustic piano, i.e., the normal direction of the paper where the figure is illustrated, and the casing 1 is formed of a magnetic substance. An inner space is defined in the casing 1, and a plurality of pairs of holes are formed in the upper and lower plate portions 1*a* and 1*b* of the casing 1. The holes in the upper plate portion are aligned with the holes in the lower plate portion, and the holes in the lower plate portion are open to the back and white keys 2 of the keyboard.

The prior art electromagnetic actuator unit further comprises a plurality of bobbins 3 respectively inserted into the pairs of holes and supported by the casing 1. The bobbins 3 have respective cylindrical holes open to the black and white keys 2, respectively.

A plurality of solenoid coils 4 are respectively wound on the outer surfaces of the bobbins 3, and are housed in the casing 1. The solenoid coils 4 are electrically connected to a controller 5, and the controller 5 selectively energizes the solenoid coils 4 for performing music.

A plurality of plungers 6 of a magnetic substance are inserted into the cylindrical holes of the bobbins 3, and are movable in the cylindrical holes. Each of the plurality of plungers 6 has an upper portion 6*a* large in diameter, a lower portion 6*b* small in diameter and merged with the upper portion 6*a* and a stopper blade 6*c* spaced from the upper portion 6*a*.

A plurality of coil strings 7 are respectively provided between shoulder portions 6*d* of the plungers 6 and ring members 8 respectively fixed to the lower surfaces of the bobbins 3, and upwardly urge the associated plungers 6 at all times. The coil springs 7 are placed in the cylindrical holes of the bobbins 3, and are respectively exposed to the magnetic fields produced by the associated solenoid coils 4.

The plurality of solenoid coils 4, the plurality of plungers 6, the plurality of springs 7 and the ring members 8 form parts of the prior art electromagnetic actuator unit.

While no current is flowing through the solenoid coils 4, the coil springs 4 upwardly urges the associated plungers 6, and the plungers 6 are staying at home positions thereof. The leading ends of the plungers 6 at the hole position are slightly spaced from the upper surfaces of the associated black/white keys 2, and allow the black/white keys 2 to remain in the rest position.

When the controller 5 starts a performance, the solenoid coils 4 are selectively energized with current, and the energized solenoid coils 4 causes the plungers 6 to downwardly project against-the coil springs 7. The leading ends of the plungers 6 depress the associated black/white keys 2, and move the black/white keys 2 from the rest positions toward the end positions. On the way from the rest position to the end position, the jack (not shown) associated with each depressed key 2 escapes from the butt, and the butt (not shown) and, accordingly, the hammer head (not shown) are driven for rotation toward the associated set of music strings (not shown). The hammer head strikes the music strings, and the music strings vibrate for producing an acoustic sound.

When the controller 5 cuts off the current, the coil springs 7 upwardly urge the associated plungers 6, and the plungers 6 return to the respective home positions.

A problem is encountered in the prior art electromagnetic actuator unit in that malfunction takes place due to deformed coil springs 7. Another problem is noise produced in the electromagnetic actuator unit. When a user newly installs a new electromagnetic actuator unit, the malfunction and the noise do not take place. However, the prior art electromagnetic actuator unit tends to make mistake in the performance and becomes noisy with time.

SUMMARY OF THE INVENTION

It is therefore an important object of the present invention to provide an electromagnetic actuator unit which serves for long time period without malfunction.

The present inventors contemplated the deformed coil springs 7, and noticed that the coil springs 7 were magnetized due to the strong magnetic field in the cylindrical spaces. The magnetic force deformed the coil springs 7, and the coil springs 7 were pressed against the inner surfaces of the bobbins 3. The large friction to the inner surfaces damaged the coil springs 7, and made the noise.

In accordance with one aspect of the present invention, there is provided an electromagnetic actuator unit provided over a keyboard of a musical instrument implemented by a plurality of keys independently movable between respective rest positions and respective end positions, a recovery force being produced at all times by each of the plurality of keys urged toward the rest position, comprising a plurality of electromagnetic actuators respectively associated with the plurality of keys, each of the plurality of electromagnetic actuators comprising a) a stationary member of a magnetic substance, b) a coil member associated with the stationary member and producing a magnetic field through the stationary member when current flows therethrough, and c) a plunger unit of a magnetic substance movable with respect to the stationary member, and associated with one of the keys, a magnetic force exerted on the plunger unit in the magnetic field downwardly moving the associated key from the rest position toward the end position against the recovery force, a gravity exerted on the plunger unit being less than the recovery force so that the plunger unit allows the associated key to return to the rest position when the magnetic field is removed.

In accordance with another aspect of the present invention, there is provided an electromagnetic actuator unit provided for a keyboard of a musical instrument implemented by a plurality of keys independently movable between respective rest positions and respective end positions, comprising a plurality of electromagnetic actuators respectively associated with the plurality of keys, each of the plurality of electromagnetic actuators comprising a) a stationary housing member formed of a magnetic substance, b) a solenoid coil housed in the stationary housing member and producing a magnetic field through the stationary housing member when current flows therethrough, c) a plunger unit formed of a magnetic substance and movable inside of the solenoid coil by the aid of the magnetic field, the plunger unit having a first end portion projecting from one end of the solenoid coil, and d) a spring member inserted between the one end of the solenoid coil and the first end portion of the plunger unit for urging the plunger unit against a magnetic force produced in the magnetic field.

A shield member of a non-magnetic substance may be inserted between the stationary housing member and the plunger unit.

BRIEF DESCRIPTION OF THE DRAWINGS

The feature and advantages of the electromagnetic actuator unit according to the present invention will be more clearly understood from the following description taken in conjunction with the accompanying drawings in which.

DESCRIPTION OF THE PREFERRED EMBODIMENTS

First Embodiment

Figure 1:
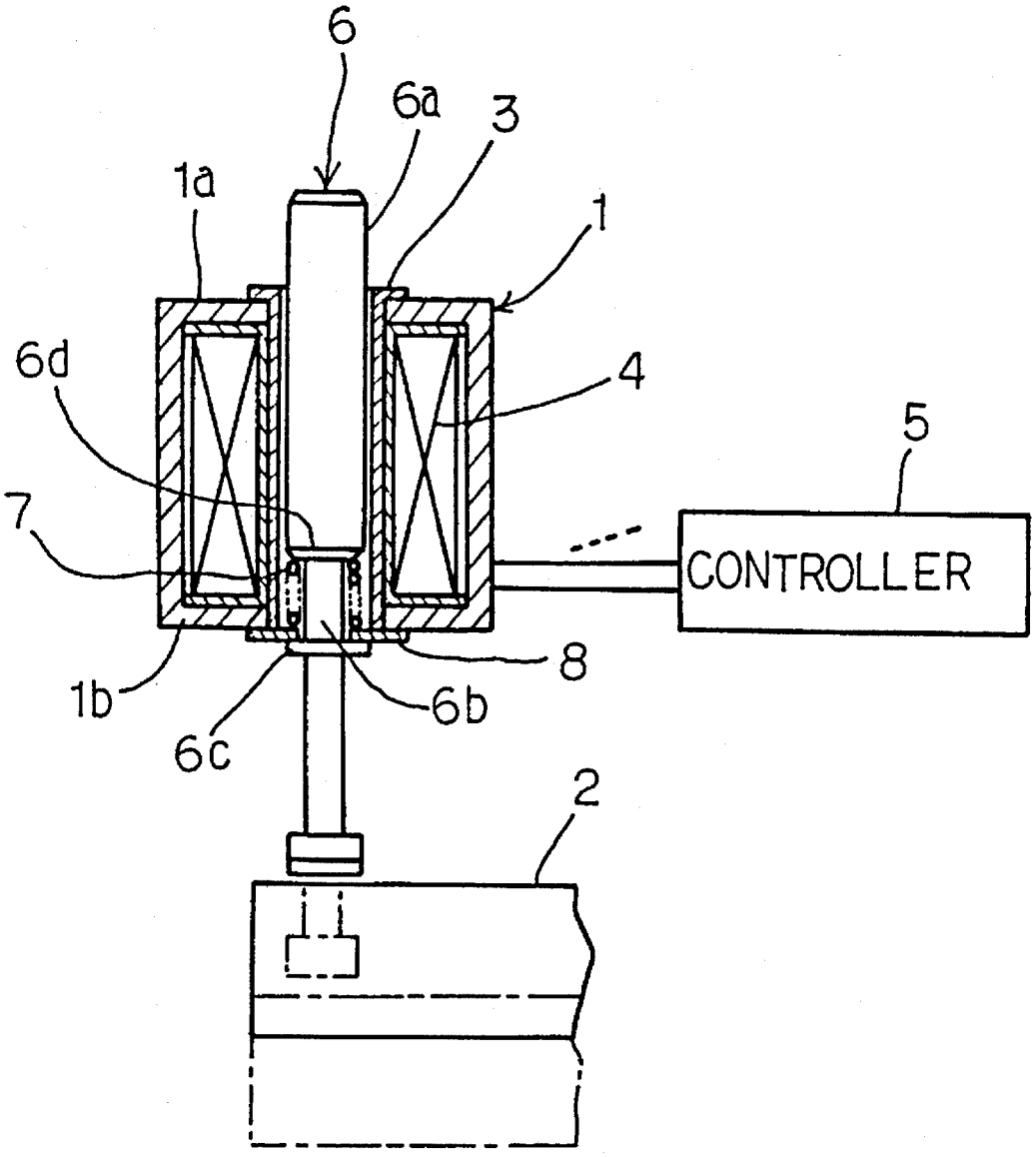
Fig. 1 PRIOR ART
FIG. 1 is a cross sectional view showing the structure of the prior art electromagnetic actuator used for the acoustic piano.
Figure 2:
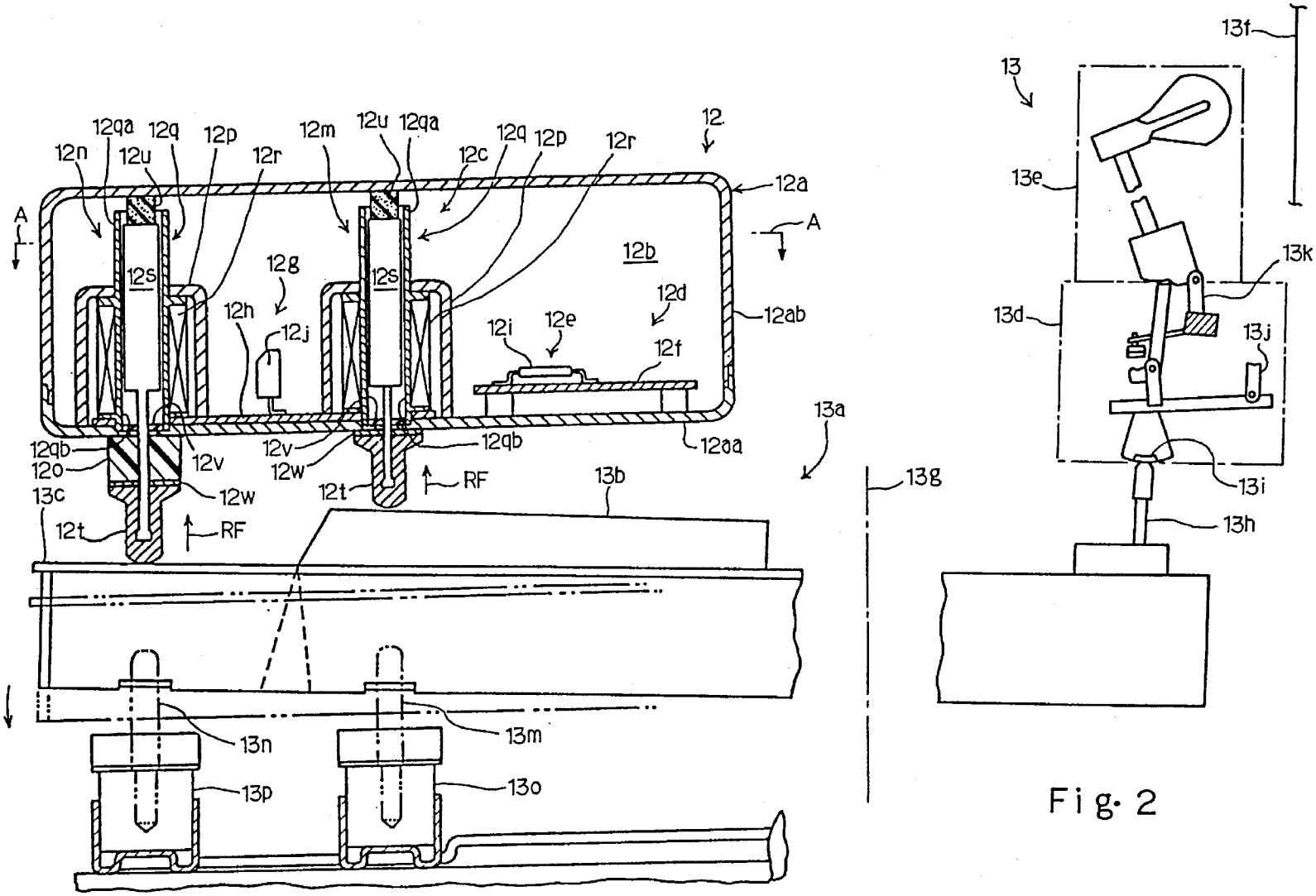
FIG. 2 is a partially cross sectional side view showing an automatic playing apparatus provided for an acoustic piano according to the present invention.

Referring to FIG. 2 of the drawings, an electromagnetic actuator unit embodying the present invention is incorporated in an automatic playing apparatus 12, and the automatic playing apparatus 12 is mounted on an upright piano 13. The upright piano 13 is a standard type, and has a keyboard 13*a* implemented by a plurality of black and white keys 13*b* and 13*c*, a plurality of key action mechanisms 13*d* respectively associated with the black and white keys 13*b* and 13*c*, a plurality of hammer assemblies 13*e* respectively driven for rotation by the key action mechanisms 13*d* and a plurality of sets of music wires 13*f* struck with the hammer assemblies 13*e* for producing acoustic sounds.

The black and white keys 13*b* and 13*c* are turnable with respect to balance pins 13*g*, respectively, and capstan screws 13*h* implanted into the rear end portions of the black and white keys 13*b* and 13*c* are held in contact with whippen heel cloths 13*i* of the associated key action mechanisms 13*d*. Although each key action mechanism 13*d* and each hammer assembly 13*e* are rotatably supported by a whippen flange 13*j* and a butt flange 13*k*, part of the weight of the key action mechanism 13*d* and part of the weight of the hammer assembly 13*e* are exerted on the capstan screw 13*h*, and push down the associated key 13*b*/13*c*. For this reason, the parts of the weights produce a moment around the balance pin 13*g*, and the moment due to the parts of the weights and a moment due to unbalance of the key 13*b*/13*c* generate a recovery force RF as will be described hereinbelow.

Thus, the total moment urges the black and white keys 13*b* and 13*c* to rotate in the clockwise direction at all times, and the black and white keys 13*b* and 13*c* are maintained at respective rest positions without an external force. However, if an external force imparts a moment in the counter clockwise direction larger than the total moment in the clockwise direction, the key 13*b*/13*c* is downwardly moved from the rest position to the end position, and causes the key action mechanism to drive the hammer assembly 13*e* for rotation. Front pins 13*m* and 13*n* are provided for the front end portions of the black and white keys 13*b* and 13*c*, and front rails 13*o* and 13*p* set limits to the rotations of the black and white keys 13*b* and 13*c* in the counter clockwise direction. In the standard pianos, the external force ranging from 30 grams to 60 grams starts the key 13*b* and 13*c* to rotate in the counter clockwise direction.

The automatic playing apparatus 12 comprises a frame work 12*a* having an inner space 12*b*, an electromagnetic actuator unit 12*c* and an electronic controlling system 12*d*, and the electromagnetic actuator unit 12*c* and the electronic controlling system 12*d* are provided in the inner space 12*b*. The frame work 12*a* is elongated in the lateral direction of the keyboard 13*a*, and is split into a bottom pan 12*aa* of a magnetic substance and an upper cap 12*ab* removable from the lower pan 12*aa*. Though not shown in FIG. 2, the bottom pan 12*aa* is supported by appropriate stationary members of the upright piano, and forms a gap between the black and white keys 13*b* and 13*c*.

The electronic controlling system 12*d* comprises a controlling circuit 12*e* fabricated on a circuit board 12*f* and a driving circuit 12*g* fabricated on another circuit board 12*g*. A microprocessor 12*i* is incorporated in the controlling circuit 12*e*, and is soldered to a conductive wiring pattern formed on the circuit board 12*f*. The microprocessor 12*i* is communicable with a memory unit (not shown) storing digital data codes indicative of a performance recorded through a fingering on a keyboard. The digital data codes may be formatted in accordance with MIDI (Musical Instrument Digital Interface) standards, and are indicative of note-on/note-off and key velocity, by way of example. The memory unit may be accommodated in a stool (not shown) for a player and connected through wirings (not shown) to the microprocessor 12*i*.

The conductive pattern on the circuit board 12*f* is connected through wirings to a conductive pattern formed on the other circuit board 12*h*, and an array of power transistors 12*j* is connected to the conductive pattern on the circuit board 12*h*. The power transistors 12*j* supply current through another conductive pattern on the circuit board 12*h* to the electromagnetic actuator unit 12*c*.

Figure 3:
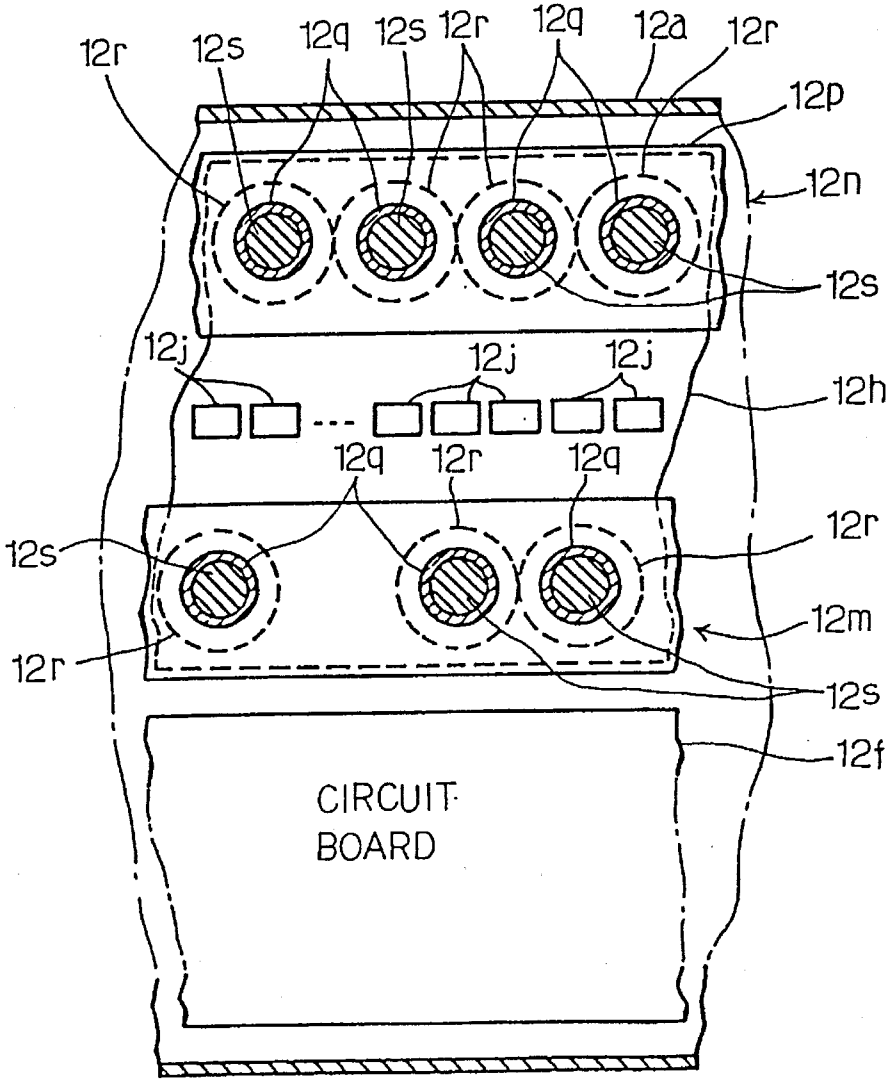
FIG. 3 is a cross sectional view taken along line A—A of FIG. 2.

The electromagnetic actuator unit 12*c* is implemented by a plurality of electromagnetic actuators 12*m* and 12*n*, and the electromagnetic actuators 12*m* and 12*n* are respectively associated with the black and white keys 13*b* and 13*c*. Namely, the electromagnetic actuators 12*m* are respectively used for depressing the black keys 13*b*, and are provided between the circuit boards 12*f* and 12*h*. On the other hand, the electromagnetic actuators 12*n* are respectively assigned to the white keys 13*c*, and provided on the opposite side of the circuit board 12*h* to the electromagnetic actuators 12*m* as will be better seen from FIG. 3. The location of the electromagnetic actuators 12*m* is desirable for the controlling circuit 12*e*, because the electromagnetic actuators 12*m* prevent the controlling circuit 12*e* from noise due to pulse signals produced by the power transistors 12*j*.

The electromagnetic actuators 12*m* are similar to the electromagnetic actuators 12*n* except for a spacer members 12*o*, and description is focused on one of the electromagnetic actuators 12*n*. The component members of each electromagnetic actuator 12*m* are labeled with the same references as those designating the corresponding component members of the electromagnetic actuator 12*n*.

The electromagnetic actuator 12*n* comprises a yoke member 12*p* shared with the other electronic actuators 12*n*, a cylindrical bobbin 12*q* inserted in the yoke member 12*p* for forming an inner space therebetween, a solenoid coil 12*r* wound on the outer surface of the bobbin 12*q* in the inner space and a plunger 12*s* passing through the cylindrical bobbin 12*q*. The solenoid coil 12*r* is directly soldered to the conductive pattern on the circuit board 12*h*, and generates a magnetic field when the associated power transistor 12*j* supplies current through the conductive pattern thereto. The yoke 12*p* is formed of a magnetic substance, and the cylindrical bobbin 12*q* is formed of non-magnetic substance. Therefore, the magnetic field extends through the yoke 12*p* and the bottom pan 12*ab* for driving the plunger 12*s*.

The bobbin 12*q* has an upper portion 12*qa* projecting from the yoke 12*p* and a lower portion 12*qb* fixed through the circuit board 12*h* to the bottom pan 12*aa*. The plunger 12*s* is slidably received in the cylindrical bobbin 12*q*, and is also formed of a magnetic substance. The plunger 12*s* has an upper portion with a large diameter and a lower portion with a small diameter, and the lower portion of the plunger 12*s* projects through the bobbin 12*q* and the bottom pan 12*aa* toward the associated key 13*c*.

In this instance, the plungers 12*s* of the electromagnetic actuators 12*m* and 12*n* are substantially aligned with the front pins 13*m* and 12*n*.

The electromagnetic actuator 12*n* further comprises a pusher 12*t* fixed to the leading end of the lower portion of the plunger 12*s*, a cushion member 12*u* attached to the upper end of the upper portion of the plunger 12*s*, a cushion sheet 12*v* attached to the bottom pan 12*aa* and a cushion sheet 12*w* attached to the upper surface of the pusher 12*t*. The spacer member 12*o* is attached to the upper surface of the cushion sheet 12*w* of the electromagnetic actuators 12*n*. However, the spacer member 12*o* is deleted from the electromagnetic actuators 12*m*, because gap between the bottom pan 12*aa* and the keyboard 13*a* is decreased at the black keys 13*b*.

When the plunger 12*s* is downwardly urged, and the shoulder between the upper portion and the lower portion is brought into contact with the cushion sheet 12*v*, and the cushion sheet 12*v* takes up the impact so that noise is not produced. On the other hand, when the plunger returns to the initial position, the cushion member 12*u* absorbs the impact against the upper cap 12*ab*, and noise is not produced. The cushion sheet 12*w* absorbs the motion of the plunger 12*s*.

The plunger 12*s*, the pusher 12*t*, the spacer member 12*o*, the cushion sheet 12*w* and the cushion member 12*u* as a whole constitute a plunger unit, and the gravity exerted on the plunger unit is less than the recovery force RF. Of course, the plunger unit for the electromagnetic actuator 12*m* does not include the spacer member 12*o*. As described hereinbefore, when the minimum external force ranging from 30 grams to 60 grams is exerted to each of the black and white keys 13*b* and 13*c*, the key starts the rotational. Therefore, the total weight of the plunger unit should be lighter than the minimum external force, and the plunger 12*s* may be partially cylindrical for decreasing the weight. In this instance, the plunger unit is less than 30 grams.

When the solenoid coil 12*r* produces the magnetic field, a magnetic force is exerted on the plunger 12*s* in the magnetic field for urging downwardly. The total of the magnetic force and the gravity of the plunger unit is greater than the recovery force RF, and, for this reason, the plunger unit pushes down the associated key from the rest position to the end position.

Assuming now that a player requests the automatic playing apparatus to reproduce a music, the microprocessor 12*i* sequentially fetches the digital data codes stored in the memory unit, and instructs the power transistors 12*j* to selectively supply current or the pulse signal to the solenoid coils 12*r* of the electromagnetic actuators 12*m* and 12*n*. The duty ratio of the pulse signal may be changed depending upon the magnitude of an impact against the music strings 13*f* to be expected in the performance.

Each of the energized solenoid coils 12*r* produces a magnetic field extending through the yoke 12*p*, the associated cylindrical bobbin 12*q* and the bottom pan 12*aa*, and a magnetic force is exerted on the associated plunger 12*s* in the magnetic field. As a result, the plunger 12*s* downwardly projects, and the pusher 12*t* pushes down the associated key 13*b*/13*c*.

The key 13*b* and 13*c* thus pushed down actuates the associated key action mechanism 13*d*, and the key action mechanism 13*d* drives the associated hammer assembly 13*e* for rotation. The hammer assembly 13*e* strikes the associated set of music strings 13*f*, and the music strings 13*f* vibrate for producing an acoustic sound having the note assigned to the depressed key.

After the projection of the plunger 12*s*, no current is supplied to the solenoid coil 12*r*, and the magnetic field is removed. The recovery force RF rotates the key in the clockwise direction, and the key returns toward the rest position against the weight of the plunger unit. The cushion sheet 12*w* and the cushion member 12*u* absorb the impact against the frame work 12*a*, and the plunger 12*s* softly returns to the initial position without noise.

In this way, the electromagnetic actuators 12*m* and 12*n* selectively push down the black and white keys 13*b* and 13*c*, and reproduces the music.

As will be appreciated from the foregoing description, the plungers 12*s* return to the initial positions without return springs, and the electromagnetic actuator unit 12*c* according to the present invention is free from a trouble due to a deformed return spring. Moreover, the electromagnetic actuators 12*m* and 12*n* according to the present invention are simpler than the prior art electromagnetic actuator unit, and decreases the production cost of the automatic playing apparatus.

Second Embodiment

Figure 4:
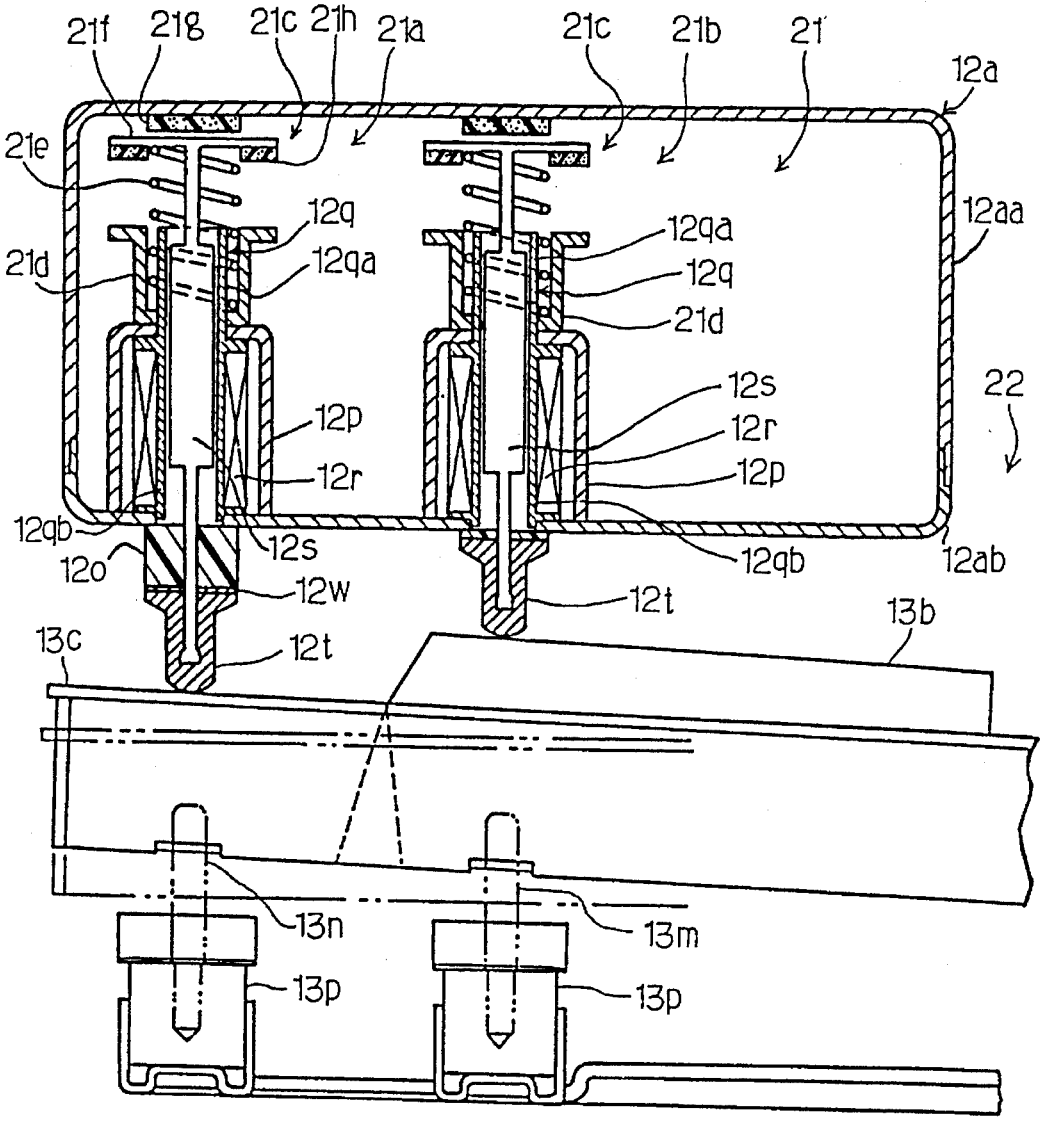
FIG. 4 is a partially cross sectional side view showing another automatic playing apparatus provided for an acoustic piano according to the present invention.

Turning to FIG. 4 of the drawings, another electromagnetic actuator unit 21 embodying the present invention is incorporated in an automatic playing apparatus. References designating the component parts and members of the first embodiment are labeled with corresponding component parts and members without detailed description for the sake of simplicity. The components of an acoustic piano 22 are also labeled with the same references designating corresponding members of the acoustic piano 13.

The electromagnetic actuator unit 21 also comprises a plurality of electromagnetic actuators 21*a* and 21*b* associated with the black and white keys 13*b* and 13*c* and an electronic controlling system (not shown). The electronic controlling system is similar to that of the first embodiment. Namely, the electronic controlling circuit 12*e* fabricated on the circuit board 12*f* and the driving circuit 12*g* fabricated on the circuit board 12*h* are incorporated in the electronic controlling system, and the circuit board 12*h* is located between the electromagnetic actuators 21*a* and the electromagnetic actuators 21*b* for shielding the electronic controlling circuit 12*e* from noise.

The electromagnetic actuators 21*a* are analogous to the electromagnetic actuator 21*b* except for the spacer member 12*o*, and only one of the electromagnetic actuators 21*a* is described hereinbelow.

The electromagnetic actuator 21*a* has a return spring unit 21*c*, and the return spring unit 21*c* comprises a retainer 21*d* formed of a non-magnetic substance, a return spring 21*e* for upwardly urging the plunger 12*s*, a disk member 21*e* merged with the plunger 12*s*, a cushion member 21*g* attached to the inner surface of the upper cap 12*aa* in opposing relation to the disk member 21*e* and a ring-shaped cushion member 21*h* attached to the lower surface of the disk member 21*f*. The retainer 21*d* has an inner space larger in diameter than the cylindrical bobbin 12*q*, and is fixed to the yoke 12*p*. The lower end portion of the return spring 21*e* is inserted into the inner space defined between the retainer 21*d* and the cylindrical bobbin 12*q*, and is held in contact with the bottom surface of the retainer 21*d*. On the other hand, the upper end of the return spring 21*e* is held in contact with the lower surface of the disk member 21*f*, and the return spring 21*e* urges the disk member 21*f* and, accordingly, the plunger 12*s* upwardly.

In this instance, the return string 21*e* causes the plunger 12*s* to be lightly held in contact with the associated key, and is regulated in such a manner that the force against the associated key does not exceed 20 grams, because a force greater than 20 grams undesirably pushes the associated key to a position slightly lower than the rest position. For this reason, if the plunger 12*s* is heavier than 20 grams, the return spring 21*e* prevents the associated key from undesirable position.

The return spring 21*e* is provided outside of the yoke 12*p*, and is less affected by the magnetic field produced by the solenoid coil 12*r*. Moreover, the retainer 21*d* of the non-magnetic substance shields the return spring 21*e* from the magnetic field. As a result, the return spring 21*e* is never magnetized, nor deformed.

Even if the retainer 21*d* of the non-magnetic substance is not incorporated, the return spring 21*e* is hardly magnetized in short time period, and the electromagnetic actuator unit 21 can serve without trouble.

The electromagnetic actuator unit 21 implementing the second embodiment behaves as similar to the electromagnetic actuator unit 12*c*, and the behavior is not described for avoiding repetition.

As will be appreciated from the foregoing description, the electromagnetic actuator unit according to the present invention is free from the undesirable influences of the magnetic field, and is operable for prolonged time period without malfunction.

Although particular embodiments of the present invention have been shown and described, it will be obvious to those skilled in the art that various changes and modifications may be made without departing from the spirit and scope of the present invention. For example, the automatic playing apparatus equipped with the electromagnetic actuator unit of the present invention may be used for a composite keyboard musical instrument disclosed in U.S. Ser. No. 08/073,092. Moreover, the electromagnetic actuator unit according to the present invention may be incorporated in an automatic player piano, the composite keyboard musical instrument or another electronic keyboard instrument.

What is claimed is:

1. An electromagnetic actuator unit provided over a keyboard of a musical instrument implemented by a plurality of keys independently movable between respective rest positions and respective end positions, a recovery force being produced at all times by each of said plurality of keys urged toward said rest position, said plurality of keys being grouped into black keys and white keys different in length from the black keys, comprising a plurality of electromagnetic actuators respectively associated with said plurality of keys and arranged in two rows of electromagnetic actuators, one of said two rows of electromagnetic actuators and the other row of electromagnetic actuators being respectively provided for said black keys and said white keys, each of said plurality of electromagnetic actuators comprising a) a stationary member of a magnetic substance, b) a coil member associated with said stationary member and producing a magnetic field through said stationary member when current flows therethrough, and c) a plunger unit of a magnetic substance movable with respect to said stationary member, and associated with one of said keys, a magnetic force exerted on said plunger unit in said magnetic field downwardly moving the associated key from said rest position toward said end position against said recovery force, a gravity exerted on said plunger unit being less than said recovery force so that said plunger unit allows the associated key to return to said rest position when said magnetic field is removed, an electronic controlling system being associated with said electromagnetic actuators, said electronic controlling system comprising:

an electric driver circuit fabricated on a first circuit board located between said two rows of electromagnetic actuators for supplying currents to said two rows of electromagnetic actuators, and an electronic controlling circuit fabricated on a second circuit board located on the opposite side of said one of said two rows of electromagnetic actuators to said first circuit board, said electromagnetic actuator unit and said electronic controlling system being accommodated in a casing.

2. An electromagnetic actuator unit provided over a keyboard of a musical instrument implemented by a plurality of keys independently movable between respective rest positions and respective end positions, a recovery force being produced at all times by each of said plurality of keys urged toward said rest position, comprising a plurality of electromagnetic actuators respectively associated with said plurality of keys, each of said plurality of electromagnetic actuators comprising a) a stationary member of a magnetic substance and including a yoke having an inner space and a cylindrical bobbin assembled with said yoke and passing through the inner space, b) a coil member associated with said stationary member and producing a magnetic field through said stationary member when current flows therethrough, and c) a plunger unit of a magnetic substance movable with respect to said stationary member and associated with one of said keys, said plunger unit including a plunger formed of said magnetic substance and having an upper portion movable in said cylindrical bobbin and a lower portion projecting from said upper portion toward the associated key and a pusher attached to a leading end of said lower portion for moving the associated key, a magnetic force exerted on said plunger unit in said magnetic field downwardly moving the associated key from said rest position toward said end position against said recovery force, a gravity exerted on said plunger unit being less than said recovery force so that said plunger unit allows the associated key to return to said rest position when said magnetic field is removed, said electromagnetic actuator unit being accommodated in a casing from said lower portion projects, said electromagnetic actuator unit further comprising a first cushion member attached to one of an upper surface of said pusher and a lower surface of said casing for absorbing an impact therebetween and a second cushion member attached to one of an upper surface of said upper portion and an inner surface of said casing for absorbing an impact therebetween.

3. An electromagnetic actuator unit provided for a keyboard of a musical instrument implemented by a plurality of keys independently movable between respective rest positions and respective end positions, said plurality of keys being grouped into black keys and white keys different in length from the black keys, comprising a plurality of electromagnetic actuators respectively associated with said plurality of keys, said plurality of electromagnetic actuators being arranged in two rows of electromagnetic actuators, one of said two rows of electromagnetic actuators and the other row of electromagnetic actuators being respectively provided for said black keys and said white keys, each of said plurality of electromagnetic actuators comprising a) a stationary housing member formed of a magnetic substance, b) a solenoid coil housed in said stationary housing member and producing a magnetic field through said stationary housing member when current flows therethrough, c) a plunger unit formed of a magnetic substance and movable inside of said solenoid coil by the aid of said magnetic field, said plunger unit having a first end portion projecting from one end of said solenoid coil, and d) a spring member inserted between said one end of said solenoid coil and said first end portion of said plunger unit for urging said plunger unit against a magnetic force produced in said magnetic field, wherein an electronic controlling system is associated with said electromagnetic actuators, said controlling system including an electric driver circuit fabricated on a first circuit board located between said two rows of electromagnetic actuators for supplying currents to said two rows of electromagnetic actuators and an electronic controlling circuit fabricated on a second circuit board located on the opposite side of said one of said two rows of electromagnetic actuators to said first circuit board, said electromagnetic actuator unit and said electronic controlling system being accommodated in a casing.

4. An electromagnetic actuator unit provided for a keyboard of a musical instrument implemented by a plurality of keys independently movable between respective rest positions and respective end positions, comprising a plurality of electromagnetic actuators respectively associated with said plurality of keys, each of said plurality of electromagnetic actuators comprising a) a stationary housing member formed of a magnetic substance, b) a solenoid coil housed in said stationary housing member and producing a magnetic field through said stationary housing member when current flows therethrough, c) a plunger unit formed of a magnetic substance and movable inside of said solenoid coil by the aid of said magnetic field, said plunger unit having a first .end portion projecting from one end of said solenoid coil, d) a spring member inserted between said one end of said solenoid coil and said first end portion of said plunger unit for urging said plunger unit against a magnetic force produced in said magnetic field, e) a first retainer of a non-magnetic substance attached to an outer surface of said stationary housing member, and f) a second retainer fixed to said first end portion of said plunger unit, said spring member being provided between said first retainer and said second retainer.

5. The electromagnetic actuator unit as set forth in claim 4, in which further comprising a first cushion member attached to one of said first retainer and said second retainer for absorbing an impact therebetween.

6. An electromagnetic actuator unit provided for a keyboard of a musical instrument implemented by a plurality of keys independently movable between respective rest positions and respective end positions, comprising a plurality of electromagnetic actuators respectively associated with said plurality of keys, each of said plurality of electromagnetic actuators comprising a) a stationary housing member formed of a magnetic substance and including a yoke having an inner space and a cylindrical bobbin assembled with said yoke and passing through the inner space, b) a solenoid coil housed in said stationary housing member and producing a magnetic field through said stationary housing member when current flows therethrough, c) a plunger unit formed of a magnetic substance and movable inside of said solenoid coil by the aid of said magnetic field, said plunger unit including a first end portion projecting from one end of said solenoid coil, an intermediate portion connected to said first end portion and movable in said cylindrical bobbin and a second end portion projecting from said intermediate portion toward the associated key and a pusher attached to a leading end of said second end portion for moving the associated key, and d) a spring member inserted between said one end of said solenoid coil and said first end portion of said plunger unit for urging said plunger unit against a magnetic force produced in said magnetic field, wherein said electromagnetic actuator unit is accommodated in a casing from which said second end portion projects, said electromagnetic actuator unit further comprising a first cushion member attached to one of an upper surface of said pusher and a lower surface of said casing for absorbing an impact therebetween and a second cushion member attached to one of an upper surface of said upper portion and an inner surface of said casing for absorbing an impact therebetween.

* * * * *